US006138743A

United States Patent [19]

Zajber et al.

[11] Patent Number: 6,138,743

[45] Date of Patent: Oct. 31, 2000

[54] LIFTING TABLE WITH OSCILLATION DRIVE FOR A CONTINUOUS CASTING PLANT

[75] Inventors: Adolf Zajber, Langenfeld; Axel Weyer, Wuppertal; Gerhard Arnolds, Mülheim, all of Germany

[73] Assignee: SMS Schloemann-Siemag Aktiengesellschaft, Düsseldorf, Germany

[21] Appl. No.: 09/291,078

[22] Filed: Apr. 14, 1999

[30] Foreign Application Priority Data

Apr. 21, 1998 [DE] Germany ..... 198 17 701

[51] Int. Cl.[7] ..... B22D 11/053

[52] U.S. Cl. ..... 164/416; 164/478

[58] Field of Search ..... 164/416, 478

[56] References Cited

U.S. PATENT DOCUMENTS

| | | | |
|---|---|---|---|
| 3,664,409 | 5/1972 | Kolomeitsev et al. | 164/416 |
| 4,612,970 | 9/1986 | Grothe | 164/416 |
| 5,201,909 | 4/1993 | Von Wyl et al. | 164/416 X |
| 5,202,134 | 4/1993 | Moellers et al. | 164/416 X |
| 5,642,769 | 7/1997 | Thone et al. | 164/416 |
| 6,015,006 | 1/2000 | Cassels et al. | 164/416 |

FOREIGN PATENT DOCUMENTS

| | | | |
|---|---|---|---|
| 43 41 719 | 4/1995 | Germany . | |
| 59-64142 | 4/1984 | Japan | 164/416 |
| 60-148645 | 8/1985 | Japan | 164/416 |

*Primary Examiner*—J. Reed Batten, Jr.
*Attorney, Agent, or Firm*—Friedrich Kueffner

[57] ABSTRACT

A device for continuously casting steel includes a continuous casting mold supported in a lifting table and oscillating in the casting direction and at least one oscillation drive acting on the lifting table. The lifting table is constructed with guide blocks extending underneath the plane of the table and a stationary clamping block is arranged between the guide blocks. At least two individual resiliently soft plate springs are mounted along the short sides of the mold underneath the table plane in both sides of the clamping block and extending between the clamping block and the adjacent guide block, wherein the plate springs are arranged at a distance one above the other and so as to extend parallel relative to the corresponding plate springs arranged at the opposite short side of the mold.

6 Claims, 2 Drawing Sheets

LIFTING TABLE WITH OSCILLATION DRIVE FOR A CONTINUOUS CASTING PLANT

BACKGROUND OF THE INVENTION

1. Field of the Invention

The present invention relates to a device for continuously casting steel including a continuous casting mold supported in a lifting table and oscillating in the casting direction and at least one oscillation drive acting on the lifting table.

2. Description of the Related Art

Hydraulic oscillation drives for lifting tables of continuous casting plants are known in the art. The drives produce an oscillation of the mold with any desired speed curves, for example, in accordance with an asymmetrical sinusoid. The technical background for influencing the oscillation movement of the lifting table and, thus, of the mold, is the desire to extend the lubricating time between the mold wall and the strand skin and to obtain an optimum negative strip time. These effects advantageously influence the oscillation mark formation, particularly the oscillation mark depth. In addition, the temperature constancy of the strand skin is improved over the entire width of the mold.

For example, DE 43 41 719 C1 discloses a device for continuously casting steel including a continuous casting mold which oscillates in the casting direction and is connected to a hydraulic oscillation drive which, in addition to the usual sinusoidal oscillation curves, also permits oscillation curves having a different shape. The continuous casting mold is mounted at spring stacks which are fixedly mounted and pretensioned at both ends and extend transversely of the casting direction, wherein these spring stacks are provided on both sides of the continuous casting mold laterally next to the short side plates. Arranged in the middle between the stacks of springs arranged one on top of the other is a fastening block each under which is arranged an oscillation drive constructed as a servo hydraulic cylinder and, thus, the oscillation drive is composed of two cylinders. The fastening blocks transmit the oscillation movement carried out by the hydraulic cylinders to the mold attached to the fastening blocks.

Also known in the art is an oscillation device for a continuous casting mold with a so-called parallelogram lever system. Parallel levers which support the mold table with the mold are pivotably guided at a bearing housing. Several hydraulic cylinders are provided for producing an oscillating movement of the continuous casting mold. The servo cylinders are anchored in a stationary manner to their base plate and are connected in an articulated manner through their piston rods to the mold table. The lateral displacement of the mold table is compensated by an elastic connecting element.

A disadvantage of the parallelogram lever system is the large amount of space required for installing such an oscillation device in an existing continuous casting plant.

SUMMARY OF THE INVENTION

Therefore, starting from the prior art discussed above, it is the primary object of the present invention to provide a continuous casting plant of the above-described type which can be operated with almost any desired speed curve and which simultaneously is constructed with little mass and is compact with respect to space.

In accordance with the present invention, the lifting table is constructed with guide blocks extending underneath the plane of the table and a stationary clamping block is arranged between the guide blocks. At least two individual resiliently soft plate or flat springs are mounted along the short sides of the mold underneath the table plane in both sides of the clamping block and extending between the clamping block and the adjacent guide block, wherein the plate springs are arranged at a distance one above the other and so as to extend parallel relative to the corresponding plate springs arranged at the opposite short side of the mold.

The mold table may be composed, for example, of two U-shaped saddle-type support members arranged at the short sides of the mold and connected to each other through crossbeams extending parallel to the long sides of the mold. In this embodiment, the downwardly facing legs of the saddle-type support members form the guide blocks of the lifting table, wherein the stationary clamping block is arranged in the middle between the guide blocks. In accordance with another embodiment, the saddle-type support members can be mounted with their legs facing upwardly, i.e., with the U-shape being open upwardly and inverted as compared to the legs of the first embodiment. The hydraulic cylinders of the oscillation drive can then be mounted so as to be suspended from a stationary support frame which extends across the saddle-type support members.

Conventional pretensioned stacks of plate springs also serve the purpose of supporting the mold. The solution of the invention is entirely different. This is because the two pairs of plate springs provided at each short side of the mold and including thin individual plate springs which are spaced apart from each other and extend parallel to each other no longer carry out a supporting function. They center the lifting table and facilitate a tumble-free mold movement. As a result of the parallel arrangement of the plate springs in the longitudinal direction and in the direction of movement at each side of the mold saddle, the lifting table and, thus, the mold are exactly guided. When a mold is placed on two independent lifting tables, the parallel arrangement of the thin and soft plate springs simultaneously produces the result that the individual lifting tables are balanced. Consequently, the two pairs of plate springs at each side facilitate a static support and the guidance of the lifting table in the transverse direction and in the longitudinal direction. Because the soft and thin plate springs do not exert any substantial counter-force and can bend without problems, it is additionally possible to operate any desired curve, i.e., to operate with different speeds.

In accordance with a preferred embodiment of the invention, the oscillation drive is composed of four hydraulic cylinders, wherein always two cylinders are arranged at each side of the mold and wherein the cylinders are fastened at one end to the guide blocks and with another end to a stationary support frame. Consequently, any occurring different friction forces at the mold sides can be absorbed by the preferably position-controlled or force-controlled hydraulic cylinders. In addition, by using two cylinders arranged at each side, it is possible to achieve a precise and controlled movement of the lifting table because the forces or torques are always in an equilibrium and are not oscillated by the pairs of springs composed of individual plate springs.

In accordance with a preferred embodiment of the invention, the support frame serves for the stationary support of the hydraulic cylinders and of the clamping blocks. Consequently, the entire system is mounted in a single frame which is stationary relative to the oscillating lifting table. However, it is of course alternatively also possible that the hydraulic cylinders and the clamping blocks are each mounted on different stationary support surfaces.

In accordance with an advantageous feature, a mold short side drive mounted laterally of the lifting table can be used as an alternative oscillation drive. This is possible because the continuous casting plant is already exactly guided as a result of the two pairs of plate springs arranged at each short side of the mold.

In accordance with an advantageous further development of the invention, the hydraulic cylinders are arranged laterally next to the guide blocks in a transverses sectional plane extending through the guide blocks.

In accordance with a further development of the invention, the hydraulic cylinders are connected with one end to a lower portion of the guide block and with another end above this connection to the stationary support frame. The resulting suspended arrangement of the hydraulic cylinders and the lifting table connected thereto produces an improved inherent stability of the movable parts of the continuous casting plant.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
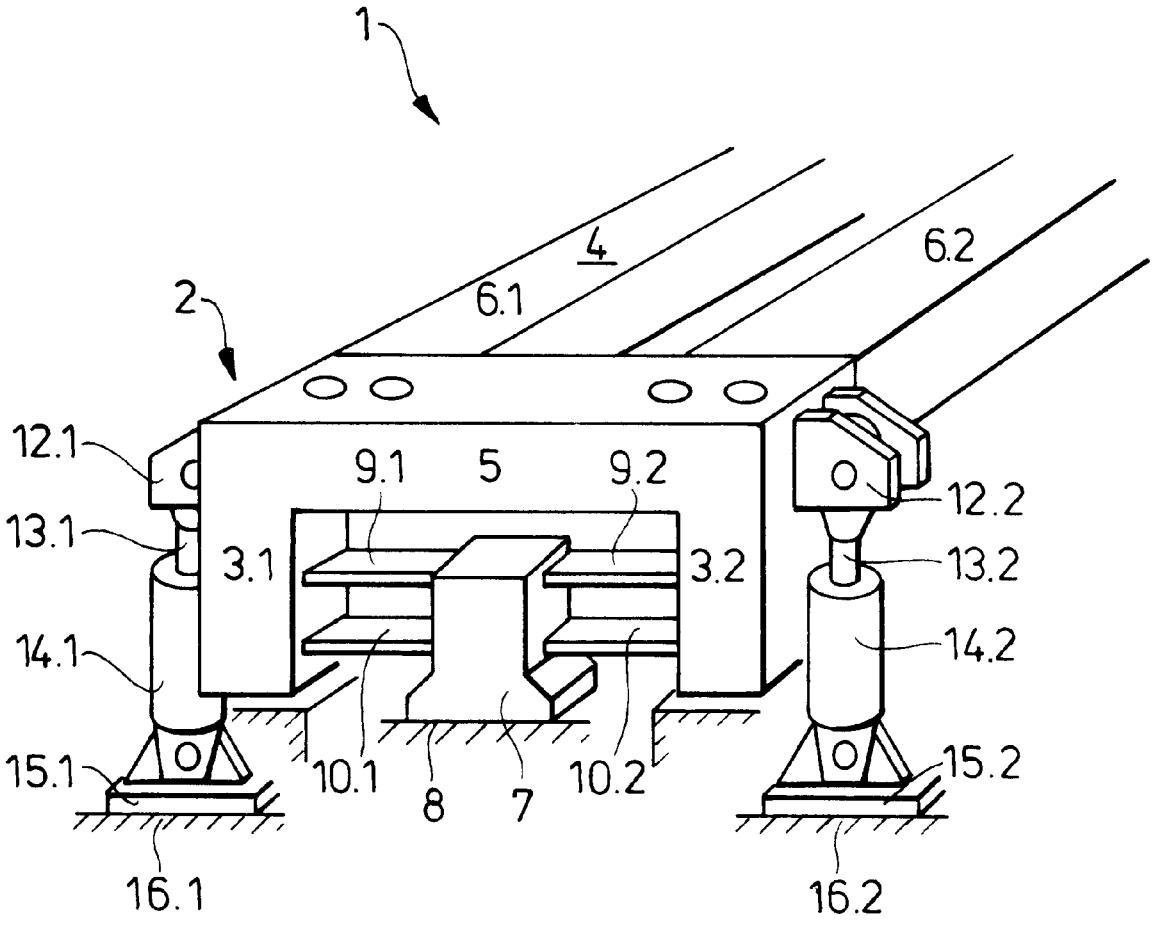
FIG. 1 is a partial perspective view of a device for continuous casting with two pairs of plate springs arranged at each short side of a lifting table.

As shown in the drawing, a lifting table 1 includes U-shaped saddle-type support members 2 arranged at the short sides of a mold, not shown in FIG. 1. The saddle-type support members 2 are formed by two guide blocks 3.1, 3.2 and a transverse beam 5 extending horizontally in the plane 4 of the table 1.

Extending in the direction of the long side of the mold at a right angle from the transverse beam 5 are long side beams 6.1 and 6.2 which at their other ends are connected to another U-shaped saddle-type support member 2 of identical construction. The other surfaces of the long side beams 6.1, 6.2 and of the short side transverse beam 5 form the table plane 4 for receiving the mold.

Arranged in the middle between the guide blocks 3.1 and 3.2 is a clamping block 7 which is anchored on a foundation support 8. Two individual thin plate springs arranged one above the other are attached in the form of pairs of plate springs 9.1, 10.1 and 9.2, 10.2 to the clamping block 7. Each plate spring 9.1, 9.2 and 10.1, 10.2 is on one side connected to the guide block 3.1 or 3.2 and the other side to the stationary clamping block 7.

Bearing flanges 12.1, 12.2 are provided at the sides of the guide blocks 3.1, 3.2. A piston rod 13.1, 13.2 each of a hydraulic cylinder 14.1, 14.2 is connected in an articulated manner to the bearing flanges 12.1 and 12.2, respectively.

The lower ends of the hydraulic cylinders 14.1, 14.2 are supported in an articulated manner through fastening flanges 15.1, 15.2 to foundation supports 16.1, 16.2.

Figure 2:
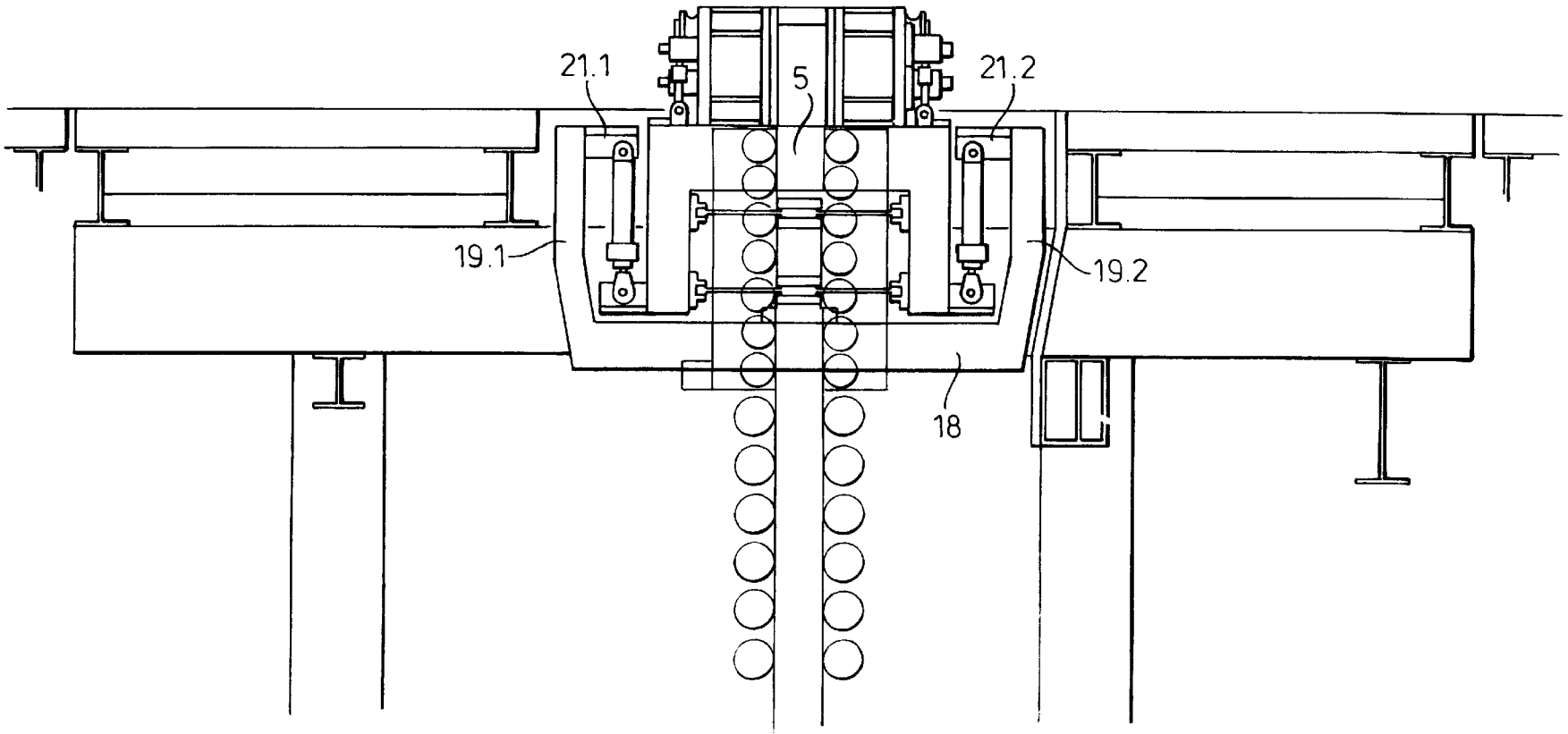
FIG. 2 is a longitudinal sectional view of another embodiment of the oscillation drive of a continuous casting plant.

Concerning the explanation of the embodiment of FIG. 2 with a "suspended" arrangement of the lifting table 1, reference should also be had to the explanations concerning FIG. 1. Corresponding structural groups are provided with identical reference characters.

The principal difference of the embodiment according to FIG. 2 is the fact that the clamping block 7 and the hydraulic cylinders 14.1 and 14.2 do not have their abutments in foundation supports but in a uniform support frame 18 which makes possible a suspended arrangement of the lifting table. For this purpose, in the embodiment illustrated in FIG. 2, the bearing flanges 12.1, 12.2 for receiving the piston rods 13.1, 13.2 (illustrated in detail in FIG. 1) are arranged at the bottom of the guide blocks 3.1, 3.2. Moreover, for this purpose, the support frame 18 has in a cross-sectional plane extending through the guide blocks 3.1, 3.2 upwardly extending support arms 19.1, 19.2 and transverse arms 21.1, 21.2 at the top of each support arm 19.1, 19.2. The hydraulic cylinders are connected through their cylinder bottoms in an articulated manner to the transverse arms 21.2, 21.2.

In a modified embodiment, the downwardly open U-shaped saddle-type support members and the stationary support frame may be swung upwardly in the plane of the drawing of FIG. 2 by 180°, i.e., the U-shaped saddle-type support members may be inverted so as to be upwardly open and the support frame 18 may be arranged so as to bridge the saddle-type support member. In that case, the cylinders are suspended from the stationary support frame.

While specific embodiments of the invention have been shown and described in detail to illustrate the inventive principles, it will be understood that the invention may be embodied otherwise without departing from such principles.

We claim:

1. A device for continuously casting steel comprising a continuous casting mold supported in a lifting table and configured to be oscillating in a casting direction, and at least one oscillation drive acting on the lifting table, wherein the lifting table is comprised of guide blocks extending underneath a table plane at each short side of the continuous casting mold, a stationary clamping block mounted between the guide blocks, and at least two individual resiliently soft plate springs arranged at a distance and spaced apart from each other mounted on both sides of the clamping block and extending between the clamping block and an adjacent guide block, wherein the plate springs are mounted in a parallel position relative to each other and relative to the plate springs mounted in the guide blocks on an opposite short side of the mold.

2. The device for continuously casting steel according to claim 1, wherein the oscillation drive is comprised of four hydraulic cylinders, wherein two hydraulic cylinders are arranged at each short side of the mold, and wherein the hydraulic cylinders are connected with one end thereof to the guide blocks and with another end thereof to a stationary support frame.

3. The device for continuously casting steel according to claim 2, wherein the hydraulic cylinders are mounted laterally next to the guide blocks in a cross-sectional plane extending through the guide blocks.

4. The device for continuously casting steel according to claim 2, wherein the clamping block is mounted on the support frame.

5. The device for continuously casting steel according to claim 2, wherein the hydraulic cylinders are connected with one end thereof to a lower portion of the guide block and with another end thereof above the connection at the lower portion to the stationary support frame.

6. The device for continuously casting steel according to claim 1, wherein the oscillation drive is comprised of at least one drive for the mold short side arranged laterally of the lifting table.

* * * * *